US010624469B2

(12) United States Patent
Carlitz

(10) Patent No.: US 10,624,469 B2
(45) Date of Patent: Apr. 21, 2020

(54) REVERSIBLE MATTRESS WITH VARYING FIRMNESS

(71) Applicant: Stuart Carlitz, New Hope, PA (US)

(72) Inventor: Stuart Carlitz, New Hope, PA (US)

(73) Assignee: Mattress Development Company of Delaware, LLC, North Brunswick, NJ (US)

( * ) Notice: Subject to any disclaimer, the term of this patent is extended or adjusted under 35 U.S.C. 154(b) by 183 days.

(21) Appl. No.: 15/592,950

(22) Filed: May 11, 2017

(65) Prior Publication Data

US 2017/0325597 A1 Nov. 16, 2017

Related U.S. Application Data

(60) Provisional application No. 62/336,092, filed on May 13, 2016.

(51) Int. Cl.

| | |
|---|---|
| ***A47C 27/14*** | (2006.01) |
| ***A47C 27/15*** | (2006.01) |
| *A47C 27/00* | (2006.01) |

(52) U.S. Cl.

CPC ..... *A47C 27/148* (2013.01); *A47C 27/14* (2013.01); *A47C 27/15* (2013.01); *A47C 27/001* (2013.01); *A47C 27/002* (2013.01)

(58) Field of Classification Search

CPC ..... A47C 27/001; A47C 27/002; A47C 27/14; A47C 27/142; A47C 27/144; A47C 27/146; A47C 27/148; A47C 27/15

See application file for complete search history.

(56) References Cited

U.S. PATENT DOCUMENTS

| | | | | | |
|---|---|---|---|---|---|
| 2,838,771 | A | * | 6/1958 | Goodman | A47C 27/127 5/309 |
| 3,274,625 | A | | 9/1966 | Hendrix | |
| 3,534,417 | A | * | 10/1970 | Boyles | A47C 27/148 5/727 |
| 4,316,298 | A | * | 2/1982 | Russo | A47C 27/001 5/411 |
| RE32,734 | E | * | 8/1988 | McLeod | A47C 21/06 5/722 |

(Continued)

OTHER PUBLICATIONS

International Search Report and Written Opinion to PCT/US2017/032376 dated Jul. 24, 2017.

*Primary Examiner* — Peter M. Cuomo
*Assistant Examiner* — Ifeolu A Adeboyejo
(74) *Attorney, Agent, or Firm* — Dinsmore & Shohl

(57) ABSTRACT

A reversible mattress includes a first outer region and a core region placed beneath the first outer region. The core region includes at least one core portion. The reversible mattress further includes a second outer region placed beneath the core region. The first outer region, the core region, and the second outer region are each made of latex foam and form the reversible mattress. The first outer region has a first outer ILD ($ILD_{T1}$) and the second outer region has a second outer ILD ($ILD_{T2}$) such that the first outer ILD ($ILD_{T1}$) is lower than the second outer ILD ($ILD_{T2}$).

17 Claims, 3 Drawing Sheets

(56) References Cited

U.S. PATENT DOCUMENTS 5,628,093 A * 5/1997 Goodale ..... A44B 19/382 24/381
5,638,562 A * 6/1997 Masoncup ..... A47G 9/0246 5/482
5,639,145 A * 6/1997 Alderman ..... A47C 7/021 297/452.45
5,819,349 A * 10/1998 Schwartz ..... A47C 27/001 5/740
6,115,861 A * 9/2000 Reeder ..... A61G 7/05776 5/690
6,263,532 B1 * 7/2001 Miller ..... A47C 31/105 29/91.1
7,469,437 B2 * 12/2008 Mikkelsen ..... A47C 7/742 5/740
7,661,166 B1 2/2010 Marling et al.
7,886,385 B2 * 2/2011 Carlitz ..... A47C 27/002 5/500
8,037,562 B2 * 10/2011 Kemper ..... A47C 27/001 5/655.9
8,209,804 B2 * 7/2012 Apperson ..... A47C 27/05 5/691
8,448,315 B2 * 5/2013 Rensink ..... A47C 27/001 112/420
9,538,855 B2 * 1/2017 Gross ..... A47C 27/15
9,867,475 B2 * 1/2018 Kulju ..... A47C 27/05
2005/0034241 A1 * 2/2005 Prince ..... A47D 15/001 5/690
2005/0193497 A1 * 9/2005 Baker ..... A47C 27/001 5/721
2005/0278852 A1 * 12/2005 Wahrmund ..... A47C 27/05 5/636
2006/0272098 A1 12/2006 Hochschild
2008/0010751 A1 1/2008 Kemper et al.
2010/0058541 A1 * 3/2010 Kemper ..... A47C 27/001 5/701
2014/0090178 A1 * 4/2014 Morgan ..... A47C 27/148 5/740
2014/0237728 A1 * 8/2014 Oh ..... A47C 27/146 5/730
2014/0259429 A1 * 9/2014 Clayton ..... A47C 27/15 5/691
2015/0265063 A1 * 9/2015 Cappadona ..... A47C 27/002 5/698

* cited by examiner

REVERSIBLE MATTRESS WITH VARYING FIRMNESS

CROSS-REFERENCE TO RELATED APPLICATIONS

This application claims priority to U.S. Provisional Patent Application Ser. No. 62/336,092 filed May 13, 2016, which is incorporated by reference in its entirety.

FIELD OF THE INVENTION

The present invention generally relates to mattresses and specifically, reversible mattresses with varying firmness, including a first outer region and a second outer region, each having varying levels of firmness.

BACKGROUND

When purchasing a mattress, one of the biggest decisions for the consumer is selecting their firmness level. Specifically, consumers, at the time of buying the mattress, have to pick either a firmer mattress or a softer mattress. However, a consumer's preference regarding the softness or firmness of a mattress may change more often than the life of the mattress. The consumer's firmness preference may depend on factors such as physical injuries, aging, weather, and the like.

Mattresses may be available with varying firmness on outer regions of the mattress. However, in these mattresses, firmness is varied by varying the quilting panel provided on the outer regions of the mattress. However, the degree of firmness that may be varied by varying the quilting pattern has been found to be inadequate.

Therefore, there exists a need for a reversible mattress that can provide both a firmer outer region and a softer outer region that would allow the consumer to adjust the firmness or softness by simply flipping the mattress.

SUMMARY

According to one embodiment, a reversible mattress includes a first outer region and a core region placed beneath the first outer region. The core region includes at least one core portion. The reversible mattress further includes a second outer region placed beneath the core region. The first outer region, the core region, and the second outer region are each made of latex foam and form the reversible mattress. The first outer region has a first outer indentation load deflection (or ILD hereinafter) ($ILD_{T1}$) and the second outer region has a second outer ILD ($ILD_{T2}$) such that the first outer ILD ($ILD_{T1}$) is lower than the second outer ILD ($ILD_{T2}$).

According to another embodiment, a reversible mattress includes a first outer region having a first outer indentation load deflection ($ILD_{T1}$), and a core region placed beneath the first outer region, and including a first core portion having a first core indentation load deflection ($ILD_{C1}$) and a second core portion having a second core indentation load deflection ($ILD_{C2}$), the first core portion placed over the second core portion. The reversible mattress further includes a second outer region having a second outer indentation load deflection ($ILD_{T2}$) and placed beneath the second core portion such that the first outer region, the core region and the second outer region are made of latex foam and form the reversible mattress, and wherein $ILD_{C2}>ILD_{C1}>ILD_{T2}>ILD_{T1}$.

Additional features and advantages of the reversible mattress described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of various embodiments, and are incorporated into and constitute a part of this specification. The drawings illustrate the various embodiments described herein, and together with the description serve to explain the principles and operations of the claimed subject matter.

DETAILED DESCRIPTION

Figure 2:
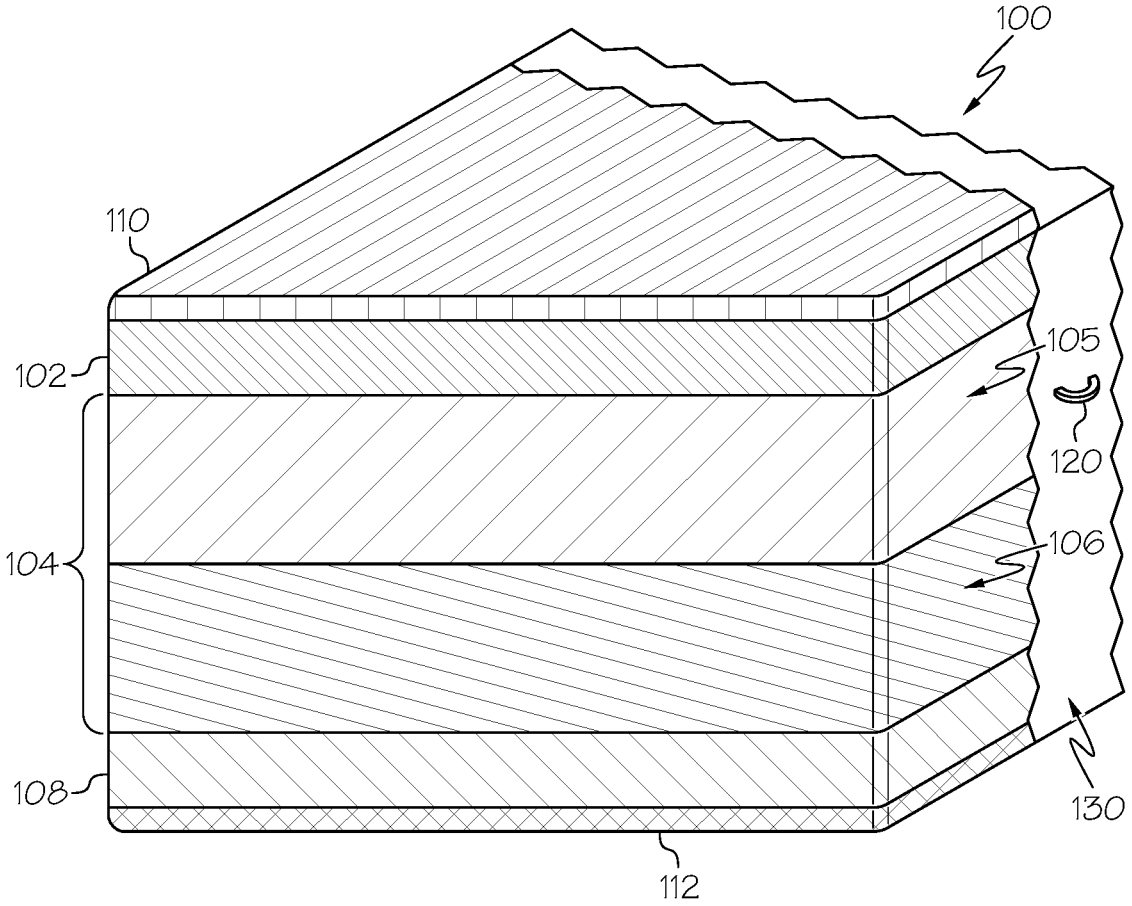
FIG. 2 is a schematic diagram of the cross section of the reversible mattress showing a first core portion and a second core portion, in addition to the first outer region and the second outer region according to one or more embodiments shown and described herein.

Reference will now be made in detail to various exemplary embodiments of a reversible mattress described herein, examples of which are illustrated in the accompanying drawings. Whenever possible, the same reference numerals will be used throughout the drawings to refer to the same or like components. Referring generally to FIG. 2, the reversible mattress includes a first outer region and a second outer region. The reversible mattress further includes a core region placed between the first outer region and the second outer region. In embodiments, the reversible mattress is constructed such that both the first outer region and the second outer region may be used to sleep on. Further, the first outer region has a lower indentation load deflection than the second outer region, making the first outer region softer than the second outer region. Therefore, the reversible mattress may be flipped on a bed frame, by the user depending on whether the user prefers the softer first outer region or the firmer second outer region.

Figure 1:
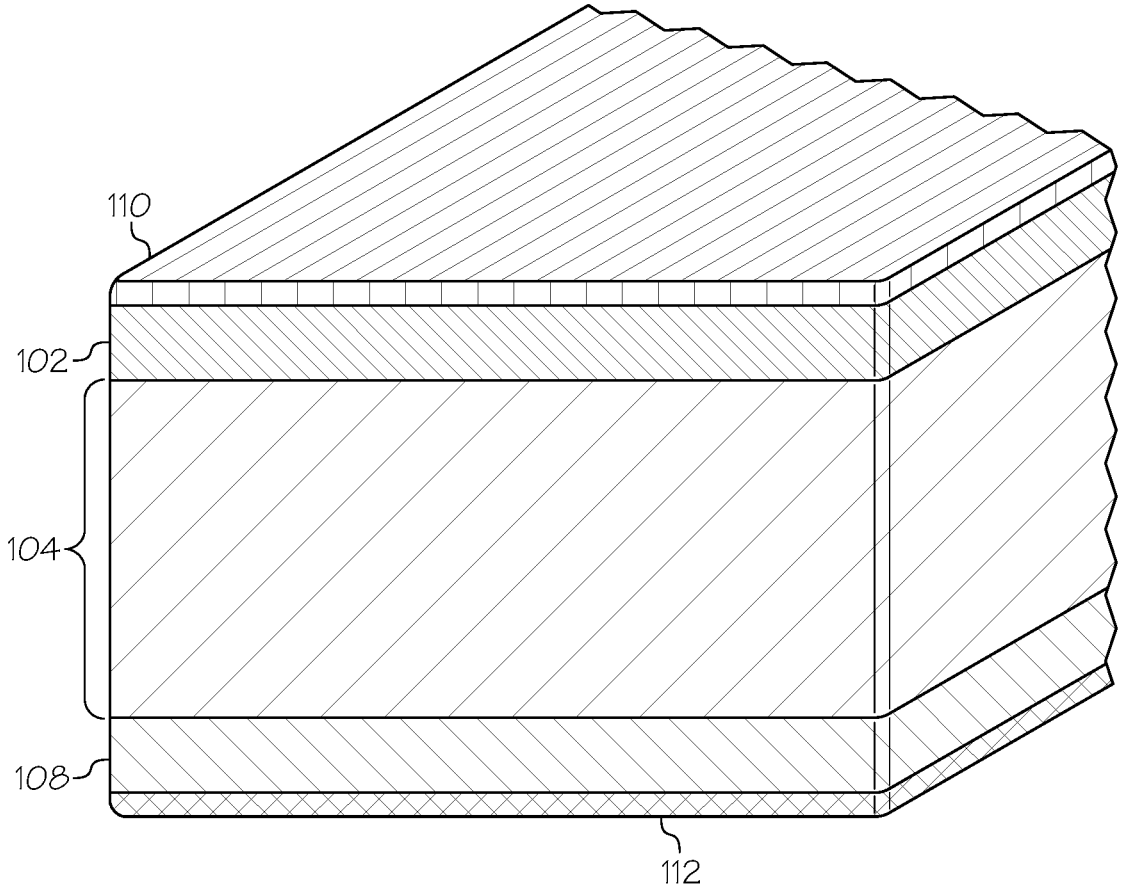
FIG. 1 is a schematic diagram of a cross section of a reversible mattress showing the first outer region, the core region and the second outer region, according to one or more embodiments shown and described herein.

Referring to FIG. 1, an exemplary embodiment of a reversible mattress 100 is shown. The reversible mattress 100 includes a first outer region 102, a second outer region 108, and a core region 104. The core region 104 is placed beneath the first outer region 102. Further, the second outer region 108 is placed beneath the core region 104, such that the core region 104 is between the first outer region 102 and the second outer region 108.

As used herein, the term "outer region" refers to the upper and lower regions of the reversible mattress 100 that are used to sleep or sit on. In embodiments, each outer region may be about 1% to about 25% of a total thickness of the reversible mattress 100. Further, as used herein, the term "core region" 104 of the mattress refers to the region between the first outer region 102 and the second outer region 108. In embodiments, the core region 104 of the reversible mattress 100 may be about 50% to about 98% of the total thickness of the reversible mattress 100.

The first outer region 102 includes a first panel 110, and the second outer region 108 includes a second panel 112. In one or more embodiments, the first panel 110 and the second panel 112 are surfaces that contact the user's body indirectly (i.e. due to an intervening mattress cover 130 or a sheet may be placed between the first panel 110 or the second panel 112 and the user). The overall dimensions of the reversible mattress 100 may be any standard mattress size, e.g., Twin, Full, Queen, King, and California King.

Referring now to FIG. 2, an embodiment of the reversible mattress 100 is depicted. In addition to the first outer region 102 and the second outer region 108, the core region 104 placed between the first outer region 102 and the second outer region 108 has a first core portion 105 and a second core portion 106. As used herein, the term "core portion" refers to one or more layers of the reversible mattress 100 that when combined form the core region 104. As shown here, the core portions 105, 106 when combined form the core region 104. While FIG. 2 depicts two core portions 105, 106, in embodiments the core region 104 may include more than two core portions. In embodiments, the first core portion 105 is placed underneath the first outer region 102, and the second core portion 106 is placed over the second outer region 108. Further, the first core portion 105 is placed over the second core portion 106. Therefore, as shown in FIG. 2, the reversible mattress 100 includes various layers, the layers including the first outer region 102, the first core portion 105 underneath the first outer region 102, the second core portion 106 underneath the first core portion 105, and the second outer region 108 underneath the second core portion 106. Additionally, in embodiments, the reversible mattress 100 further includes a mattress cover 130 that is placed over the reversible mattress 100 to protect the reversible mattress 100. The mattress cover 130 may include handles 120 which allow the user to easily flip the reversible mattress 100 between the first outer region 102, and the second outer region 108.

In embodiments, all layers 102, 105, 106, 108 are made of latex foam. In some embodiments, all layers 102, 105, 106, 108 are made of 100% natural latex foam. As a non-limiting example, Talalay™ latex foam may be used.

Referring to FIG. 2, each layer 102, 105, 106, 108 has a different indentation load deflection (hereinafter ILD). ILD is a metric used in the industry to measure the firmness or softness of a mattress. In embodiments, ILD is calculated by the number of pounds of pressure it takes to indent a 4-inch thick piece of latex foam by 25% according to ASTM D3574. ILD is defined based on an N1-N5 scale. Higher ILD indicates higher firmness and vice versa. The ILD scale is shown in Table 1 below.

TABLE 1

| N1-N5 ILD scale | |
|---|---|
| Type of latex foam | ILD Values |
| N1 | 14-19.99 ILD (Extra Soft) |
| N2 | 20-24.99 ILD (Soft) |
| N3 | 25-29.99 ILD (Medium) |

TABLE 1-continued

| N1-N5 ILD scale | |
|---|---|
| Type of latex foam | ILD Values |
| N4 | 30-34.99 ILD (Firm) |
| N5 | 35-41.99 ILD (Extra Firm) |

Still referring to FIG. 2, the first outer region 102 has a lower ILD than the second outer region 108. In embodiments, the first outer region 102 has a first outer ILD ($ILD_{T1}$) and the second outer region 108 has a second outer ILD ($ILD_{T2}$). In embodiments, the first outer ILD ($ILD_{T1}$) is lower than the second outer ILD ($ILD_{T2}$). In embodiments, the second outer ILD ($ILD_{T2}$) is within a range of about 1.0 to about 1.8 times the first outer ILD ($ILD_{T1}$). Therefore, in embodiments, the second outer region 108 is firmer than the first outer region 102. By way of a non-limiting example, the first outer ILD ($ILD_{T1}$) is N1 type latex foam and the second outer ILD ($ILD_{T2}$) is N2 type latex foam. In other embodiments, the first outer ILD ($ILD_{T1}$) is N2 type of latex foam and the second outer ILD ($ILD_{T2}$) is N4 type of latex foam.

Referring to FIG. 2, in embodiments, the first core portion 105 has a lower ILD than the second core portion 106. The first core portion 105 has a first core ILD ($ILD_{C1}$) and the second core portion 106 has a second core ILD ($ILD_{C2}$). In embodiments, the first core ILD ($ILD_{C1}$) is lower than the second core ILD ($ILD_{C2}$). In one embodiments, the second core ILD ($ILD_{C2}$) is within a range of about 1.0 to about 1.5 times the first core ILD ($ILD_{C1}$). By way of a non-limiting example, the first core ILD ($ILD_{C1}$) is N3 type latex foam and the second core ILD ($ILDc_2$) is N4 type latex foam. In other embodiments, the first core ILD ($ILD_{C1}$) may be N4 type latex foam and the second core ILD ($ILD_{C2}$) may be N5 type latex foam. In embodiments, the first core portion 105 and the second core portion 106 may have the same ILD.

Further, in embodiments, the first core portion 105 has a higher ILD than the first outer region 102. Specifically, the first core ILD ($ILD_{C1}$) is within a range of about 1.3 to about 2.0 times the first outer ILD ($ILD_{T1}$). By way of a non-limiting example, the first core ILD ($ILD_{C1}$) is N3 type latex foam and the first outer ILD ($ILD_{T1}$) is N1 type latex foam. In some embodiments, the first core ILD ($ILD_{C1}$) is N4 type latex foam and the first outer ILD ($ILD_{T1}$) is N2 type latex foam. Additionally, in embodiments, the second core portion 106 has a higher ILD than the second outer region 108. Specifically, the second core ILD ($ILD_{C2}$) is within a range of about 1.2 to about 1.8 times the second outer ILD ($ILD_{T2}$). By way of a non-limiting example, the second core ILD ($ILD_{C2}$) is made of N4 type latex foam, and the second outer ILD ($ILD_{T2}$) is made of N2 type latex foam. In embodiments, the second core ILD ($ILD_{C2}$) is made of N5 type latex foam, and the second outer ILD ($ILD_{T2}$) is made of N3 type latex foam.

In an additional embodiment, the first outer ILD ($ILD_{T1}$) of the first outer region 102 includes N1 type of latex foam and the second outer ILD ($ILD_{T2}$) of the second outer region is N2 type of latex foam. Referring to FIG. 2, the first core portion 105 has a first core ILD ($ILD_{C1}$) which is made of N2 type latex foam, and the second core portion 106 has a second core ILD ($ILDc_2$), which is made of N4 type latex foam.

Still referring to FIG. 2, in some embodiments, each of the layers 102, 105, 106, 108 have a different ILD than the other layers 102, 105, 106, 108. The first outer ($ILD_{T1}$), the second outer ILD ($ILD_{T2}$), the first core ILD ($ILD_{C1}$) and the second core ILD ($ILD_{C2}$) may be selected such that $ILD_{C2}>ILD_{C1}>ILD_{T2}>ILD_{T1}$.

Still referring to FIG. 2, the various layers of the reversible mattress 100 have different thicknesses. In embodiments, a thickness of the first outer region 102 and the second outer region 108 is within a range of about 1 inch to about 3 inches. In some embodiments, the thickness of the first outer region 102 and the second outer region 108 is within a range of about 1.5 inches to about 2 inches. In a further embodiment, the thickness of the first outer region 102 and the second outer region 108 is 1.5 inches. In embodiments, the thickness of the first outer region 102 may be different from the thickness of the second outer region 108. In some embodiments, the thickness of the first outer region 102 is the same as the second outer region 108. In embodiments, a thickness of the core region 104 is within a range of about 3 inches to about 12 inches. In some embodiments, the thickness of the core region 104 is within a range of about 4 inches to about 10 inches. In embodiments, the first outer region 102 has a first outer thickness, the second outer region 108 has a second outer thickness, and the core region has a core thickness such that the core thickness is greater than the first outer thickness and the second outer thickness combined. As a non-limiting example, the core thickness may be about four times the first outer thickness and the second outer thickness combined. In other embodiments, a thickness of the first core portion 105 and the second core portion 106 each may be within a range of about 1.5 inches to about 6 inches, or about 2 inches to about 5 inches. In one embodiment, the thickness of the first core portion 105 and the second core portion 106 may be the same. In another embodiment, the thickness of the first core portion 105 and the second core portion 106 each may be 3 inches thick. In embodiments, the thickness of the first core portion 105 may be different from the second core portion 106. In some embodiments, the thickness of each core portion 105, 106 may be two times the thickness of each outer region 102, 108. As a non-limiting example, the thickness of the first outer region 102 and the second outer region 108 is each about 1.5 inches, and the thickness of the core region 104 is about 6 inches such that the first core portion 105 and the second core portion 106 are each about 3 inches thick. In embodiments, the layers 102, 105, 106, 108 may all have equal thicknesses.

Figure 3:
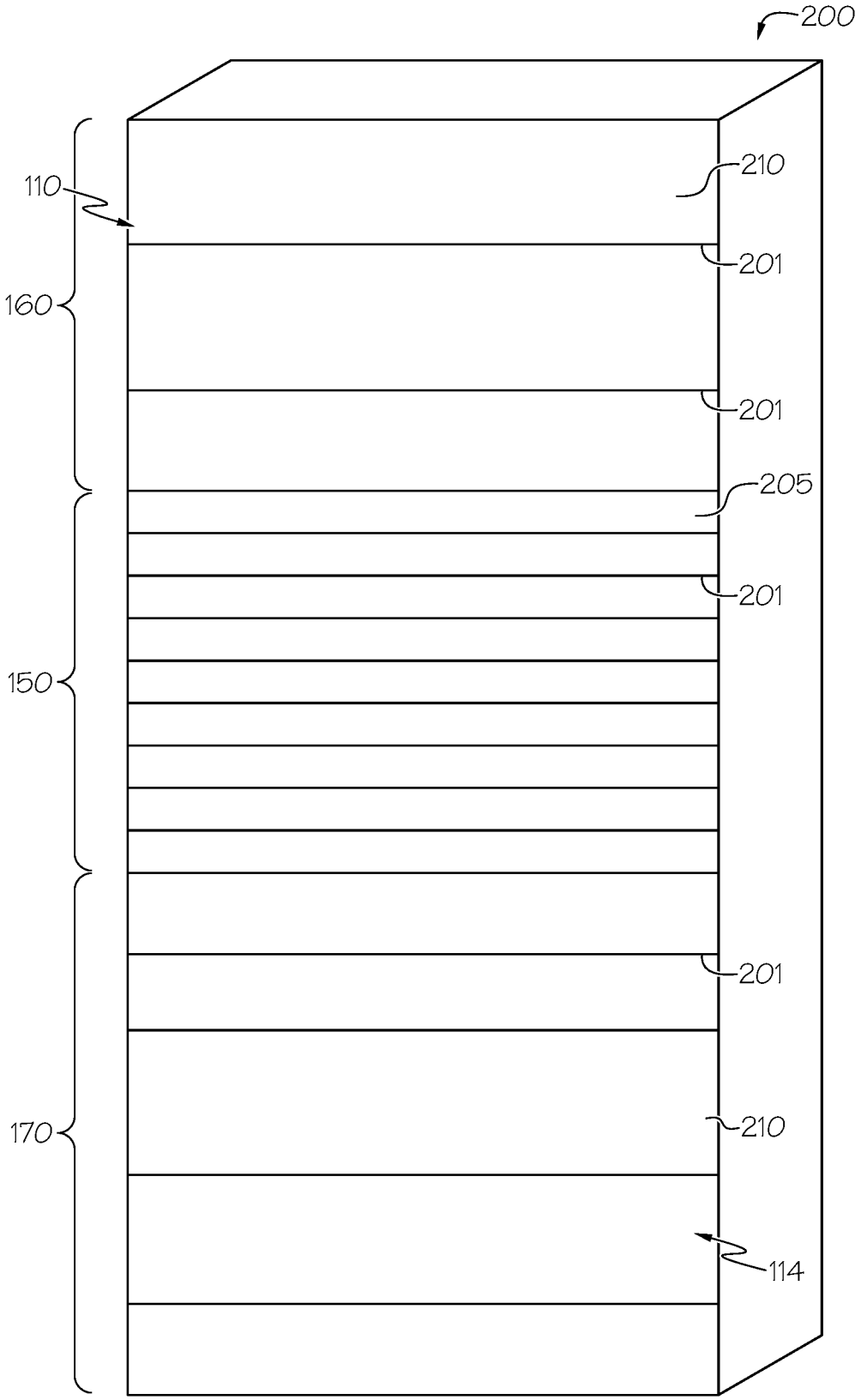
FIG. 3 is a schematic diagram of a top view of the reversible mattress depicting a first panel of the first outer region, according to one or more embodiments shown and described herein.

In one or more embodiments, one of more of the first outer region 102 and the second outer region 108 may include zoned toppers i.e., upper surfaces with regions or zones of varying firmness. This is shown in the embodiment of FIG. 3.

Still referring to FIG. 2, the first panel 110 of the first outer region 102 and the second panel 112 of the second outer region 108 are formed from a sheet of upholstery ticking stitched to a backing layer along with a support material, such as a relatively thin and less dense foam or fill layer provided therebetween. In embodiments, the first panel 110 and the second panel 112 are colored a different color from each other. This way, the user will be able to distinguish between the firm first outer region and the softer second outer region. In one or more embodiments, the first panel 110 and the second panel 112 may even carry printed labels indicating the panel's softness or firmness.

Still referring to FIG. 2, the first panel 110 and the second panel 112 are quilt panels. In embodiments, the first panel 110 and the second panel 112 include pattern stitching 114. As shown in FIG. 2, the pattern stitching 114 is provided in the form of vertical lines running along a length of the reversible mattress 100. However, other pattern stitching 114 may be used. Types of pattern stitching 114 include for example, a circle pattern (e.g., 1.6"×1.6"), a swoop pattern (e.g., 3"×2"), with other jumps ranging from 3 to 9 inches depending on desired comfort. In still other embodiments, the pattern stitching 16 may be a ribbon pattern (e.g., 6"×3"), a 213 pattern (e.g., 6"×3"), or a 301 pattern (e.g., 12"×6", or 6"×3"). In embodiments, spacing may be provided between the pattern stitching 114. It is to be appreciated that a smaller jump spacing will tend to provide firmer support, and wider spacing will provide a softer, more plush surface.

Referring to FIG. 2, the first panel 110 and the second panel 112 have a thickness within a range of about 1 inch to about 5 inches. In embodiments, the first panel 110 and the second panel 112 may have varying thicknesses from each other. As a non-limiting example, the first panel 110 and the second panel 112 each have a thickness of 2 inches. Further, as another non-limiting example, the first panel 110 and the second panel 112 may be made of Calmera®.

Referring to FIG. 3, an example embodiment of a top view of the first panel 110 of the first outer region 102 of the reversible mattress 100 is shown. The pattern stitching 114 shown on the first panel 110 are in the form of lines 201, which are horizontal and extending across a width of the reversible mattress 100. A vertical length extended between two lines 201 form channels 205, 210 that also extend along the width of the reversible mattress 100. As shown, the stitching pattern 114 provides a center section 150 of the first panel 110 that has at least twice the number of channels 205 than an adjacent head section 160 and an adjacent foot section 170. An increase in channels 205 in the center section 150 is depicted as an increase in lines 201 extending along the width of the reversible mattress 100, thereby forming channels 205 that are narrower than channels 210 formed at the head and foot sections 160, 170. In one embodiment, the center section 150 represents approximately ⅓ of the mattress 10. In other embodiment, the center section 150 may range in size from about ¼ to about ½ of the mattress. In other words, the center section 150 can range in size from about ¼ to about ½ of the total area of the first panel 110 in top view.

As shown in FIG. 3, the channels 210 at the head and foot sections 160, 170 are wider than the channels 205 at the center section 150 of the reversible mattress 100. These different channel widths may correlate to different zones or firmness regions. In embodiments, a width of the channels 205 at the center section 150 may be 0.5 times a width of the channels 210 at the head and foot sections 160, 170. In some embodiments, the width of the channels 205 at the center section 150 may be within a range of about 0.25 to about 0.75 times a width of the channels 210 at the head and foot sections 160, 170. In embodiments, the width of the channels 205 may be within a range of about 1 inch to about 12 inches. As a non-limiting example, the width of the channel 205 is 6 inches. In embodiments, the width of the channels 210 at the head and foot sections 160, 170 may be within a range of about 2 inches to about 24 inches. As a non-limiting example, the width of the channels 210 is 12 inches. While FIG. 3 shows channels 205, 210 extending across the width of the reversible mattress 100, in embodiments, the channels 205, 210 may be placed along the length of the reversible mattress 100 in as vertical channels (not shown).

It should now be understood that a reversible mattress includes a first outer region and a second outer region, and a core region place beneath the first outer region. The core region includes at least one core portion. The first outer region, the second outer region and the core region are each made of latex foam and form the reversible mattress. The reversible mattress may be used reversibly. Further, the first outer region has a first outer ILD ($ILD_{T1}$) and the second outer region has a second outer ILD ($ILD_{T2}$) such that the first outer ILD ($ILD_{T1}$) is lower than the second outer ILD ($ILD_{T2}$).

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

The invention claimed is:

1. A reversible mattress comprising:

a first outer region;

a core region placed beneath the first outer region, and comprising a first core portion having a first core indentation load deflection ($ILD_{C1}$) and a second core portion having a second core indentation load deflection ($ILD_{C2}$); and a second outer region placed beneath the core region, wherein:

the first outer region, the core region and the second outer region are each made of latex foam and form the reversible mattress, the first outer region has a first outer ILD ($ILD_{T1}$) and the second outer region has a second outer ILD ($ILD_{T2}$), and $ILD_{C2}>ILD_{C1}>ILD_{T2}>ILD_{T1}$.

2. The reversible mattress of claim 1, wherein the first core portion is placed over the second core portion.

3. The reversible mattress of claim 1, wherein:

the first core portion is placed beneath the first outer region and the second core portion is placed over the second outer region; and the second core portion having a second core ILD ($ILD_{C2}$) and the first core portion having a first core ILD ($ILD_{C1}$) such that the second core ILD ($ILD_{C2}$) is within a range of about 1.0 to about 1.5 times the first core ILD ($ILD_{C1}$).

4. The reversible mattress of claim 1, the first core ILD ($ILD_{C1}$) is within a range of about 1.3 to about 2.0 times the first outer ILD ($ILD_{T1}$).

5. The reversible mattress of claim 1, wherein $ILD_{C2}$ is within a range of about 1.2 to about 1.8 times $ILD_{T2}$.

6. The reversible mattress of claim 1, wherein the first outer region has a first outer thickness, the second outer region has a second outer thickness, the core region has a core thickness such that the core thickness is greater than the first outer thickness and the second outer thickness combined.

7. The reversible mattress of claim 1, wherein the first outer region comprises a first panel and the second outer region comprises a second panel, the first panel and the second panel being quilt panels.

8. The reversible mattress of claim 7, wherein the first panel and the second panel comprise pattern stitching.

9. The reversible mattress of claim 8, wherein the pattern stitching forms channels extending along a width of the reversible mattress.

10. The reversible mattress of claim 9, wherein a center section of the first panel of the first outer region has at least twice the channels than an adjacent head section and foot section.

11. The reversible mattress of claim 1, wherein the first outer region has a first color and the second outer region has a second color, such that the first color is different from the second color.

12. The reversible mattress of claim 1 wherein the first outer region, the core region and the second outer region are made of natural latex foam only.

13. The reversible mattress of claim 1, wherein the first outer region, the core region and the second outer region each has a different indentation load deflection.

14. A reversible mattress comprising:

a first outer region having a first outer indentation load deflection ($ILD_{T1}$);

a core region placed beneath the first outer region, and comprising a first core portion having a first core indentation load deflection ($ILD_{C1}$) and a second core portion having a second core indentation load deflection ($ILD_{C2}$), the first core portion placed over the second core portion; and a second outer region having a second outer indentation load deflection ($ILD_{T2}$) and placed beneath the second core portion, wherein:

the first outer region, the core region and the second outer region are made of latex foam and form the reversible mattress, $ILD_{C2}>ILD_{C1}>ILD_{T2}>ILD_{C1}$, and $ILD_{C2}$ is within a range of about 1.0 to about 1.5 times $ILD_{C1}$.

15. The reversible mattress of claim 14, further comprising reversible symmetry in a thickness of each region.

16. The reversible mattress of claim 14, wherein $ILD_{C1}$ is within a range of about 1.3 to about 2.0 times $ILD_{C1}$.

17. The reversible mattress of claim 16, wherein $ILD_{C2}$ is within a range of about 1.2 to about 1.8 times $ILD_{T2}$.

* * * * *